US005772846A

United States Patent [19]

Jaffee

[11] Patent Number: 5,772,846

[45] Date of Patent: Jun. 30, 1998

[54] NONWOVEN GLASS FIBER MAT FOR FACING GYPSUM BOARD AND METHOD OF MAKING

[75] Inventor: Alan Michael Jaffee, Bowling Green, Ohio

[73] Assignee: Johns Manville International, Inc., Denver, Colo.

[21] Appl. No.: 781,556

[22] Filed: Jan. 9, 1997

[51] Int. Cl.[6] ..... D21H 11/00

[52] U.S. Cl. ..... 162/145; 162/135; 162/146; 162/156; 162/168.1; 162/184; 162/186; 428/440; 442/180

[58] Field of Search ..... 162/145, 146, 162/156, 135, 168.1, 184, 186; 428/360, 440; 442/180

[56] References Cited

U.S. PATENT DOCUMENTS 4,112,174 9/1978 Hannej et al. ..... 428/220

4,647,496 3/1987 Lehnert et al. ..... 428/251

5,397,631 3/1995 Green et al. ..... 428/219

*Primary Examiner*—James J. Bell

*Attorney, Agent, or Firm*—Robert D. Touslee

[57] ABSTRACT

A new thermoformable nonwoven fibrous mat having properties particularly suited for a facer on insulating gypsum board and the method of making the mat is disclosed. The mat can also be pleated or thermoformed to produce filter elements and preforms for producing a wide range of fiber reinforced composites and laminates. The mat preferably contains a major portion of glass fibers and a minor portion of polyester fibers bound together with up to 35 wt. percent of a cross linked vinyl chloride acrylate copolymer binder having a glass transition temperature as high as about 113 degrees F., preferably about 97 degrees F. The binder also optionally contains about 3–10 wt. percent stearylated melamine.

26 Claims, No Drawings

NONWOVEN GLASS FIBER MAT FOR FACING GYPSUM BOARD AND METHOD OF MAKING

BACKGROUND OF THE INVENTION

The present invention involves a nonwoven fiber glass mat bonded together with a thermoplastic polyvinyl chloride latex binder, optionally containing a small amount of stearylated melamine, and the method of making. This mat has many uses, but is especially useful as a facing on a gypsum wall board for exterior application and on which stucco is applied.

It is known to face a gypsum wall board with a fiber glass nonwoven mat as shown in U.S. Pat. No. 4,647,496, the disclosure of which is hereby incorporated by reference. The fiber glass nonwoven mat is made by applying an aqueous solution of urea formaldehyde resin to a nonwoven web of glass fibers and then drying the web and curing the urea formaldehyde resin to form a nonwoven mat, as disclosed in U.S. Pat. Nos. 4,112,174 and 3,766,003, the disclosures of which are hereby incorporated by reference.

The fiber glass mat (Manville's 7502–2 lb.) made using a binder of urea formaldehyde performed good in the process disclosed in U.S. Pat. No. 4,647,496 to make a faced insulating gypsum board, also disclosed in that patent, but the mat was not as strong as desired which caused process breakouts adding to production costs. This mat was also more rigid than desired which made it difficult to fold around the edges of the board and also irritated the hands and arms of the workers handling and installing the insulating board product. Further, when the faced insulated gypsum board was cut, the dust from the mat was excessive and further irritated those it contacted, particularly if the workers bare arms, etc. were sweaty and exposed to the dust. Skin abrasion and irritation was also a problem for those handling the mat and the faced board when not wearing gloves and long sleeve shirts.

To address the inadequate strength problem a small portion of polyester, polyethylene terathalate (PET), fibers were used in place of an equal amount of glass fibers and the urea formaldehyde resin binder was replaced with an acrylic binder containing a small amount of a stearylated melamine. This improved the strength adequately and also improved the handling characteristics of the mat somewhat, i. e. the mat is more friendly to those handling and installing the mat or board, but the acrylic bound mat is more expensive, stiffer and less fire (flame) resistant. The use of this mat does not improve the quantity or nature of the dust generated by cutting the faced board and there is a need for a nonwoven fiber glass mat that has flame resistance as good as the urea formaldehyde bound mat and good handlability (flexibility and non abrasive/non irritating to the skin).

It is also known to make a nonwoven fiber glass mat containing particles of thermoplastic like polyvinyl chloride, polypropylene, etc. as disclosed in published European Patent Applications 0148760 and 0148761. In the first disclosure the mat is bound together with aqueous binders like polyvinyl alcohol, starch, phenol formaldehyde, etc. In both of these disclosures the particulate thermoplastic component(s) are present in the mat in amounts of 40–80 percent by weight and the mat is subjected to high temperature and pressure to melt and consolidate the thermoplastic particles into a continuous thermoplastic matrix reinforced with glass fibers. Such a mat would not be suitable as a facing for the insulating gypsum board product disclosed in U.S. Pat. No. 4,647,496.

BRIEF SUMMARY OF THE INVENTION

It is an object of the present invention to provide a nonwoven fibrous mat for use as a facer on gypsum insulating board of the type described in U.S. Pat. No. 4,647,496 having improved handling characteristics, improved flame resistance, improved flexibility and that produces less, or less irritating, dust when the faced gypsum board is cut than the mats used heretofore for facing insulating gypsum board, and also to provide a method for making such mat. It is a further object of the present invention to provide mats containing a major portion of textile glass fibers that can be pleated and thermoformed to a desired shape and then cooled to retain the formed shape and methods for making such mat. Textile glass fibers are glass fibers having an average fiber diameter of about 5 microns or larger.

The invention results from the surprising discovery that the use of a latex containing a mixture of a cross linked vinyl chloride acrylate copolymer having a glass transition temperature as high as 113 degrees F., preferably about 97 degrees F., optionally mixed with a small amount of stearylated melamine, unexpectedly produces a mat containing a major portion of textile glass fibers that satisfies long felt needs, a mat having all the properties desired for use as a facer for the insulating gypsum board, especially handlability and also a textile glass fiber mat that can be pleated to form an accordion shaped filter element. When the binder contains a small amount of stearylated melamine, the strength of the mat is also unexpectedly high.

Preferably the mat for facing the insulating gypsum board has a basis weight within the range of about 1.8 and about 2.2 pounds per 100 square feet, most preferably about 2.1 pounds per 100 sq. ft. Preferably the binder content of the dried and cured mats is within the range of about 15 wt. percent and about 25 wt. percent, most preferably about 20 wt. percent, based on the weight of the finished mat.

The present invention provides a process of making a fibrous nonwoven mat, preferably containing a major portion of glass fibers and a minor portion of polymer fibers, such as PET polyester fibers, bound together with a latex containing a mixture of a cross linked vinyl chloride acrylate copolymer having a glass transition temperature as high as about 113 degrees F., preferably about 97 degrees F., and a small amount of a stearylated melamine. The process comprises forming a wet, nonwoven web containing a major proportion of glass fibers and a minor proportion of synthetic polymer fibers in a known manner, saturating the wet web with an aqueous latex binder described above and drying the mat at a temperature exceeding 250 degrees F.

The present invention also comprises a fibrous nonwoven mat, preferably a mat containing a major portion of textile glass fibers and a minor portion of polymer fibers, such as PET polyester fibers, bound together with a mixture of a cross linked vinyl chloride acrylate copolymer having a glass transition temperature as high as about 113 degrees F., preferably about 97 degrees F. and a small amount of up to 10 wt. percent, based on the weight of binder in the dried mat, of a stearylated melamine. The acrylate comonomers suitable in the binder include n butyl acrylate, ethyl acrylate, and 2 ethyl hexyl acrylate.

Preferably the amount of stearylated melamine present in the latex, when stearylated melamine is used, is about 3 wt. percent to about 10 wt. percent and most preferably about 6 wt. percent, based on the weight or percentage of binder in the finished mat. For example, a mat of the present invention having a binder content in the dried mat of 20 wt. percent and a stearylated melamine content of 6 wt. percent would have a stearylated melamine content of 0.2 times 0.06 times 100 or 1.2 wt. percent, based on the weight of the dried mat. Stearylated melamine is added to the binder when making mats to face insulating gypsum board, but is not used when making pleatable mats.

Preferably the glass fibers are E glass fibers with a major portion of the E glass fibers having an average fiber diameter in the range of about 15 and about 16 microns and a length of about one inch. Preferably the polyester fibers have a dtex or denier of about 1.5. The binder content of the mat can be as high as about 35 wt. percent, based on the weight of the finished mat, but preferably the binder content is in the range of about 15 to about 25 wt. percent with about 20 wt. percent being most preferred. The mat can be any weight, but for use as a facer on the insulating gypsum board the preferred weight is in the range of about 1.8 and about 2.2 pounds per 100 square feet, such a about 2.1 pounds per 100 sq. ft.

The resultant mat of the present invention provides a superior facing for the insulating gypsum board described above and can also be pleated and thermoformed into desired shapes. When the mat is thermally pleated in a known manner to form an accordion shaped element, the element is useful as a filter media for air and liquids and can also be used as the liquid saturating element for humidifiers. When the mat of the present invention is to be used as a material to make filter media, glass or synthetic polymer microfibers having average fiber diameters below 5 microns to provide high efficiency filtration for very fine particles, bacteria, etc.

DETAILED DESCRIPTION OF THE INVENTION

Any type of glass fibers can be used in the present invention, but E type, C type and T glass fibers, sodium borosilicate, are preferred. The diameters and lengths of the fibers can be varied to achieve desired properties as is well known. Typically glass fibers having average diameters from about 9 microns to about 20 microns can be used, but preferably from about 10 microns to about 16 microns are used. When making a facer for the insulated gypsum board, 16 micron fibers are preferred. When making a mat to be used as an air filter media, it is preferred to add a minor portion of glass microfibers having average fiber diameter of 0.4–2 microns to produce a mat having very small windows formed by the randomly arrayed fibers to catch very fine particles.

Microdenier synthetic polymer fibers can also be used in minor portions when making a mat to be used in making filter media or elements. For some applications, like the facer for the insulated gypsum board, it is desirable to also use a minor portion of synthetic polymer fibers like PET polyester fibers or other well known thermoplastic fibers.

The fiber lengths can be all about the same or different fiber lengths can be used. Normally all the glass fiber lengths will be the same except for the glass microfiber which is a distribution of lengths from only a few times the diameter to about one half inch or longer. Glass lengths of one inch, 0.75 inch, half inch or one quarter inch can be used, but about 0.75 to about one inch lengths are preferred, especially when using 16 micron diameter fibers.

The binder used to bond the glass fibers together, with or without other fibers like synthetic polymer fibers, carbon fibers, refractory fibers, whiskers, etc., is a crosslinkable vinyl chloride acrylate copolymer latex having a glass transition temperature of up to about 113 degrees F., preferably from about 86 to about 104 degrees F. and most preferably about 97 degrees F., optionally containing about 3 to about 10 wt. percent, based on the binder in the dried mat, preferably about 6 wt. percent, of a stearylated melamine. The copolymer contains acrylate comonomers such as n butyl acrylate, ethyl acrylate, and 2 ethyl hexyl acrylate with the cross linking functionality in the form of carboxylic acid or amide.

The preferred vinyl chloride acrylate copolymer latexes for the present invention is VYCAR™ TN 819 and TN 821 (most preferred) available from B. F. Goodrich Company of Cleveland, Ohio. This vinyl chloride acrylate copolymer latex has a solids content as delivered of about 50 weight percent solids, but it is preferred to dilute the concentration with water to about 25 wt. percent solids before using.

A preferred aqueous stearylated melamine emulsion is called SEQUAPEL™ 409 and is available from the Sequa Chemical Corporation of Chester, S.C. The preferred stearylated melamine is in liquid form having a solids content of about 40 wt. percent and is mixed with the copolymer latex and water to prepare binders for the mats. This material has a pH of about 9, a viscosity of about 45 centipoise and is anionic. It is normally used for its ability to provide water repellancy, but in the present invention the stearylated melamine also acts as an external cross linker for the vinyl chloride copolymer. The water repellancy of the mat of the present invention is improved over that of the prior art mats. The presence of the stearylated melamine also increases the tensile strength significantly of the vinyl chloride acrylate copolymer, which was unexpected.

Enough vinyl chloride acrylate copolymer latex binder, optionally containing stearylated melamine, is left in the wet mat during manufacture to produce a loss on ignition, from the latex binder only of up to 25 or 30 wt. percent, based on the dry weight of the finished mat. About 15–25 wt. percent, with about 20 wt. percent being most preferred, vinyl chloride acrylate copolymer, optionally containing up to 10 wt. percent of stearylated melamine, in the final mat, based on the dry weight of the mat, is preferred.

Processes for making nonwoven fiber glass mats are well known and some of them are described in U.S. Pat. Nos. 4,112,174, 4,681,802 and 4,810,576, which references are hereby incorporated into this disclosure by reference, but any known method of making nonwoven mats can be used. The preferred technique for the making of mats of the present invention is forming a dilute aqueous slurry of fibers and depositing the slurry onto an inclined moving screen forming wire to dewater the slurry and form a wet nonwoven fibrous mat, on machines like a Hydroformer™ manufactured by Voith-Sulzer of Appleton, Wis., or a Deltaformer™ manufactured by Valmet/Sandy Hill of Glenns Falls, N.Y. Next, the wet, unbonded mat is transferred to a second moving screen running through a binder application saturating station where the latex binder is applied to the mat. The excess binder is removed, and the wet mat is transferred to a moving oven belt where the unbonded, wet mat is dried and cured, polymerizing and/or melting the resin binder bonding the fibers together in the mat.

Preferably, the aqueous binder solution is applied using a curtain coater or a dip and squeeze applicator. In the drying and curing oven the mat is subjected to temperatures of about 250–350 F. for periods usually not exceeding 1 or 2 minutes and frequently less than 40 seconds. Alternative forming methods include the use of well known cylinder forming and "dry laying".

EXAMPLE 1

A fiber slurry was prepared in a well known manner by adding one inch long wet E type glass chopped fiber having fiber diameters averaging about 16 microns to a known cationic white water containing Natrosol™ thickening agent available from Aqualon, Inc. and a cationic surfactant Aerosol C-61, an ethoxylated tallow amine available from Cytec Industries, Inc. of Morristown, N.J, as a dispersing agent to form a fiber concentration of about 0.8 weight percent. After allowing the slurry to agitate for about 20 minutes to thoroughly disperse the fibers, the slurry was metered into a moving stream of the same whitewater to dilute the fiber concentration about 5 to 10 times to a concentration averaging about 0.05 to 0.06 weight percent before pumping the diluted slurry to a headbox of a Voith Hydroformer™ where a wet nonwoven mat was continuously formed.

The wet mat was removed from the forming wire and transferred to a Sandy Hill Curtain Coater where aqueous urea formaldehyde (UF) binder of the best known type for use for this type of mat by modification with (mixed with) a blend of polyvinyl acetate homopolymer and an acrylic tripolymer. This binder was applied in an amount to provide a binder level in the cured mat of about 19–20 weight percent. The wet mat was then transferred to an oven belt and carried through an oven to dry the mat and cure the modified UF resin to a temperature of about 450 degrees F. The basis weight of the mat produced was about 2.1 per one hundred square feet and the mat had the following properties:

| | |
|---|---|
| Thickness | 36 mils |
| Loss On Ignition | 19.5–21 weight percent |
| 90 degree bend stiffness (gm cm) | 37 |
| Burn rate (ft./min.) | self extinguishing |

Other properties are shown below in a Table below. This mat was used for some time in the process disclosed in U.S. Pat. No. 4,647,496 to make glass fiber nonwoven mat faced insulating gypsum board, but its strength was lower than desired resulting in undesirable breakouts and higher scrap loss than desired. The minimum desired total tensile strength is about 170 lbs./3 in. with a minimum of 100–110 lbs./3 in. in the machine direction and a minimum of about 60–70 lbs./3 in. in the cross machine direction of the mat as made. As can be seen from the Table below, the strength of this mat is below the desirable minimum.

EXAMPLE 2

Another mat was made in the same manner described in Example 1 above except that 15 wt. percent of the E glass fiber was replaced with 1.5 denier polyester fibers one quarter of an inch long and the modified urea formaldehyde binder was replaced with an acrylic latex binder also containing a small amount of a stearylated melamine. This mat had the following properties:

| | |
|---|---|
| Thickness | 31 mils |
| Loss on ignition | 34 wt. percent (about 19–20 percent from the acrylic binder) |
| | 90 degree bend stiffness 45 |
| Burn rate | 0.64 ft./min. |

Other properties are shown in the Table below. This mat replaced the mat of Example 1 as a facer for the insulated gypsum board because of the desire for a stronger mat and because this mat was more user friendly, i. e. caused less irritation to those handling and cutting the mat. However, this mat is much stiffer than desired causing some board manufacturing problems and the lower flame resistance of this mat is undesirable.

EXAMPLE 3

A nonwoven mat was made using the same procedure as in Example 2 except that a latex of a mixture of a crosslinkable vinyl chloride acrylate copolymer, VYCAR TN 821 from B. F. Goodrich, and about 6 wt. percent, based on the weight of the binder in the dried mat (19–20 percent in this example), diluted with water to 25 wt. percent solids, was applied to the wet mat instead of the acrylic binder containing stearylated melamine. The wet mat was then transferred to a conventional conveyor belt dryer oven, dried and heated to about 350 degrees F. to cure the binder.

The properties of this mat are compared below in the Table with those of the mats of Examples 1 and 2, previous nonwoven fiber glass mats used to face insulating gypsum board. This mat had a target binder content of about 20 wt. percent. As can be seen from the comparison in the Table, the mat of the present invention is superior to the previous mats used in this application in that the mat is more flame resistant, more flexible. The greater flexibility of the mat is important because it makes it easier to bend the mat around the edges of the board in the application taught in U.S. Pat. No. 4,647,496. The mat of the present invention is also importantly more "friendly" to those handling and cutting the mat and the faced gypsum board in that there is less dust generated in cutting and there is less abrasive irritation to the skin of the workers involved. Finally, the mat of the present invention is less costly to manufacture than the acrylic resin bound mat. This mat meets a long felt need in this application where for the first time the mat has all of the properties desired for this application.

TABLE

| Tabor Mat | LOI* | Total tensile** | Stiffness*** | Burn Rate |
|---|---|---|---|---|
| Example 1 | 21% | 156 lb./3 in. | 37 | self ext. |
| Example 2 | 34 | 200 | 45 | .64 ft/min. |
| Example 3 | 34 | 208 | 33 | self ext. |

*Loss on ignition-Given as wt. percent of dry mat before burning out the organic material. Examples 3 and 4 have higher LOI than Example 1 due to the substitution of about 15 percent polyester fiber for 15 percent of the E glass fiber used in Example 1.

**This is a combination of the tensile strengths in the machine direction as made and the cross machine direction as made. Three inch wide strips of the mat are tested in the conventional manner for fiber glass nonwoven mat and averaged.

***This test measures the stiffness of the mat. The higher the number the stiffer is the mat and the lower the number the more flexible is the mat.

EXAMPLE 4

Wet mats of various types of glass fibers of various fiber diameters and various cut lengths were made into mats of various basis weights and 10–35 wt. percent binder contents using the process of Example 1 except the a 25 percent solids latexes of TN 819 and TN 821 were substituted for the modified urea formaldehyde binder used in Example 1 and these mats were dried at 250 degrees F. instead of the higher temperature used in Example 1. These mats did not contain any stearylated melamine, but could have if higher strength and water repellancy were desired. These mats could be hot pressed into various shapes which shapes were retained after cooling to form preforms for molding fiber reinforced plastic parts in a known manner. The mats could also be heated and pleated to form a pleated nonwoven for filter elements.

A particular useful fibrous mixture for making a mat for use as a liquid or gaseous prefilter is 90 wt. percent of E glass 13 micron diameter fibers one half inch long and 10 wt.

percent of code 106 sodium borosilicate glass microfibers (avg. diameter of about 0,65 microns).

Those skilled in the art will recognize other obvious modifications, equivalents and uses of the present invention once having the benefit of the present disclosure. Those modifications, and equivalents thereof, are intended to be a part of the invention claimed below.

I claim:

1. A nonwoven fibrous mat comprising fibers bound together with a mixture containing a cross linked vinyl chloride acrylate copolymer having a glass transition temperature as high as about 113 degrees F.

2. The mat of claim 1 wherein said fibers comprise glass fibers.

3. The mat of claim 2 wherein said binder comprises up to 35 wt. percent of said fibrous mat.

4. The mat of claim 1 wherein the fibrous part of the mat comprises a major portion of glass fibers and a minor portion of polymer fibers, such as PET polyester fibers.

5. The mat of claim 3 wherein the fibrous part of the mat comprises a major portion of glass fibers and a minor portion of polymer fibers, such as PET polyester fibers.

6. The mat of claim 5 wherein said binder comprises about 20 wt. percent of said mat.

7. The mat of claim 5 wherein the basis weight of said mat is within the range of about 1.8 to about 2.2 pounds per 100 square feet of mat, the glass transition temperature of the vinyl chloride copolymer is about 97 deg. F., and the binder contains about 3–10 wt. percent, based on the weight of binder in the final mat, of stearylated melamine.

8. The mat of claim 7 wherein the basis weight of said mat is about 2.1 pounds per 100 square feet of mat and the binder contains about 6 wt. percent of stearylated melamine.

9. The mat of claim 1 wherein said copolymer contains comonomers selected from the group consisting of n butyl acrylate, ethyl acrylate, and 2 ethyl hexyl acrylate.

10. The mat of claim 2 wherein said copolymer contains comonomers selected from the group consisting of n butyl acrylate, ethyl acrylate, and 2 ethyl hexyl acrylate.

11. The mat of claim 3 wherein said copolymer contains comonomers selected from the group consisting of n butyl acrylate, ethyl acrylate, and 2 ethyl hexyl acrylate.

12. The mat of claim 7 wherein said copolymer contains comonomers selected from the group consisting of n butyl acrylate, ethyl acrylate, and 2 ethyl hexyl acrylate.

13. The mat of claim 8 wherein said glass.fibers are E glass fibers having a diameter of about 16 microns and major portion of said fibers have a length of about one inch.

14. The mat of claim 2 wherein said fibers include a portion of glass microfibers having an average diameter of less than about 2 microns.

15. In a process of making a fibrous nonwoven mat comprising forming a wet, nonwoven web containing fibers, saturating the wet web with an aqueous binder, and drying the mat at a temperature exceeding 250 degrees F., the improvement comprising using as the binder an aqueous latex of a cross linked vinyl chloride acrylate copolymer binder having a glass transition temperature as high as 113 degrees F.

16. The process of claim 15 wherein said fibers comprise glass fibers.

17. The process of claim 16 wherein said mat contains up to about 35 wt. percent of said binder.

18. The process of claim 17 wherein said fibers include microfibers having an average diameter of less than about 2 microns.

19. The process of claim 17 wherein said fibers comprise a mixture of a major portion of glass fibers and a minor portion of synthetic polymer fibers such as polyester fibers.

20. The process of claim 19 wherein enough binder is added to the wet mat that binder content of the dried and cured mat is between about 15 wt. percent and about 25 wt. percent, based on the weight of said mat and wherein said binder contains about up to about 10 wt. percent, based on the binder content of the dried mat, of a stearylated melamine.

21. The process of claim 20 wherein said binder content is about 20 wt. percent and wherein said stearylated melamine is present is about 6 wt. percent.

22. The process of claim 20 wherein the forming of the mat is controlled to produce a finished mat having a basis weight in the range of about 1.8 pounds per 100 sq. ft. and about 2.2 pounds per 100 sq. ft.

23. The process of claim 21 wherein the basis weight of said finished mat is about 2.1 pounds per 100 sq. ft.

24. The process of claim 22 wherein said major portion of said glass fibers is E glass fibers, the major portion of said E glass fibers having an average fiber diameter in the range of about 15 to about 16 microns and a length of about one inch.

25. The process of claim 22 wherein said copolymer contains comonomers selected from the group consisting of n butyl acrylate, ethyl acrylate, and 2 ethyl hexyl acrylate.

26. The process of claim 23 wherein said copolymer contains comonomers selected from the group consisting of n butyl acrylate, ethyl acrylate, and 2 ethyl hexyl acrylate.

* * * * *